United States Patent [19]

Obrist et al.

[11] 4,111,322

[45] Sep. 5, 1978

[54] SYNTHETIC PLASTIC CAP FOR BOTTLES

[75] Inventors: Albert Obrist, Therwilerstrasse 12, 4153 Reinach, Switzerland; Dietmar Aichinger, Arlesheim, Switzerland

[73] Assignee: Albert Obrist AG, Reinach, Switzerland

[21] Appl. No.: 757,691

[22] Filed: Jan. 7, 1977

Related U.S. Application Data

[63] Continuation-in-part of Ser. No. 689,920, May 25, 1976, abandoned.

[51] Int. Cl.[2] ..... B65D 41/00

[52] U.S. Cl. ..... 215/230; 40/311

[58] Field of Search ..... 206/508, 459; 215/230, 215/200, 216, 202, 203, 206, 365, 367, 10; 40/307, 311, 312

[56] References Cited

U.S. PATENT DOCUMENTS

| | | | |
|---|---|---|---|
| 1,215,114 | 2/1917 | Cohen | 40/311 X |
| 1,552,134 | 9/1925 | Frey | 206/508 X |
| 1,626,930 | 5/1927 | Grogg | 206/508 |
| 2,913,140 | 11/1959 | Vuillemenot | 206/508 X |
| 2,978,142 | 4/1961 | Novick | 206/508 |
| 3,121,511 | 2/1964 | Whitehead | 206/508 X |
| 3,173,574 | 3/1965 | Goldsmith | 206/508 |
| 3,542,230 | 11/1970 | Campbell | 215/10 |
| 3,623,634 | 11/1971 | Norgard | 215/10 X |

*Primary Examiner*—Donald F. Norton
*Attorney, Agent, or Firm*—Larson, Taylor & Hinds

[57] ABSTRACT

A synthetic plastic cap for bottles is formed on its outer lid surface with an elevated portion which prevents contact with markings on the lid by articles placed on top of the bottle.

8 Claims, 10 Drawing Figures

SYNTHETIC PLASTIC CAP FOR BOTTLES

This application is a continuation-in-part of our prior co-pending U.S. application Ser. No. 689,920, filed May 25, 1976 now abandoned.

BACKGROUND OF INVENTION

This invention relates to a synthetic plastic closure cap for bottles, consisting of a cylindrical part and a top plate connected in one piece therewith, the upper side of which top plate is intended for marking with an imprint.

Such synthetic plastic closure caps are predominating more and more over metal closures by reason of the most various advantages. However in practical use the inscription or marking of the top plates of the closures causes problems in as much as the synthetic plastic closure caps on the one hand can most expediently be printed on the top plate, but the top plate is subjected to mechanical abrasion when bottles or filled bottle carriers are place one upon the other, in such a way that the marking becomes unsightly and illegible. This affects synthetic plastic closure caps quite specially, because the imprint on the conventional synthetic plastic materials can be damaged relatively easily.

In known container lids with external bead, the danger of damage is already unintentionally reduced. Such protective edges are sometimes even provided only for aesthetic reasons, as illustrated for example in U.S. Pat. No. 3,766,882. The forming of such an edge on the container lid has however the consequence that printing becomes extremely difficult and complicated. Moreover a large part of the lid area available for printing is lost. Especially if for example as a result of legal regulations a multiplicity of information must be imprinted on the lid, it is necessary to have the largest possible area available for the provision of the marking, since otherwise the inscriptions would have to be reduced to an illegibly small scale. This applies quite especially to closure caps for bottles with small diameter.

Accordingly the invention is directed to the problem of providing a closure cap of the stated kind which can be provided in an optimally simple manner with an imprint which is not damaged either in storage or in transport of the individual closures, nor can be scraped away or otherwise mechanically scratched in the stacking of filled bottles or bottle carriers one upon the other.

SUMMARY OF THE INVENTION

According to the invention this problem is primarily solved in that on the upper side of the cap an elevation is provided which extends approximately concentrically in the marginal region of the upper side, and is provided to protect the imprint against mechanical damage, the elevation rising at such a shallow angle that the elevation itself is also printable at least in a partial zone of the flanks.

As may be seen by the special formation of the lid surface, without additional measures or expensive protective or covering coatings over the imprint it is ensured that the lid surface is protected against mechanical influences, since the bodies coming into contact with the closure cap do not rest directly on the printed surface, but on the elevations. This is achieved in accordance with the invention without reduction of the area usable for the imprint. The elevation can here advantageously be made as a continuous arc of a circle. If the elevation is arranged on the outer edge of the top plate, an especially large lid area remains for the imprint. This is quite especially important if not only the name of the beverage but additional information as to the chemical composition of the beverage, storage capability, filling date, filling place etc. are to be provided on the lid.

The closure cap according to the invention is quite especially suitable for printing by ordinary commercial silicone pad printing machines. These printing machines provide the transmission of a printed image taken from a printing block on to the top of the lid in that a soft silicone pad adapting itself to the surface of the top plate is used for the transmission of the printing. The function and manner of operation of such printing machines are incidentally generally known and therefore will not be explained in greater detail here. By appropriate formation of the elevated portion and especially by its bevelling off to the top plate it can however here be ensured that on the one hand distortion-free transference of the printed image to the lid surface is rendered possible and on the other hand a maximum of printable area is available.

According to the mechanical influences and stresses to which the lid surface is subjected, obviously the configuration of the elevated portion can be adapted to the specific case of utilisation. The same applies also to the adaption to the graphic configuration of the imprint.

The invention will be explained in greater detail hereinafter in examples of embodiment with reference to the drawings, wherein:

Figure 1:
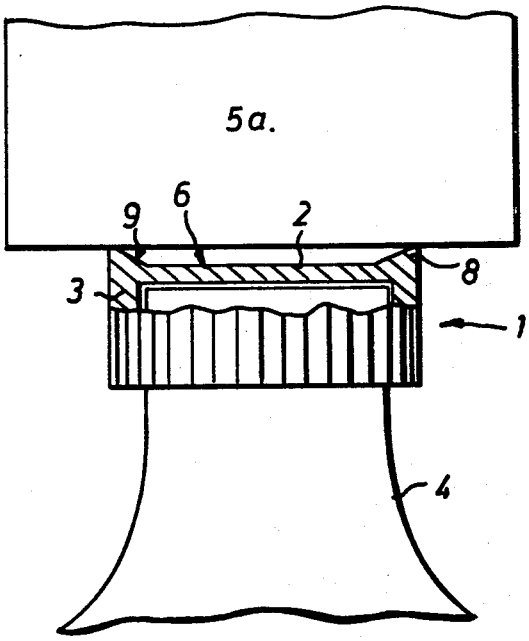
FIG. 1 shows a lateral elevation with partial section through a synthetic plastic closure cap having the features of the invention.
Figure 2:
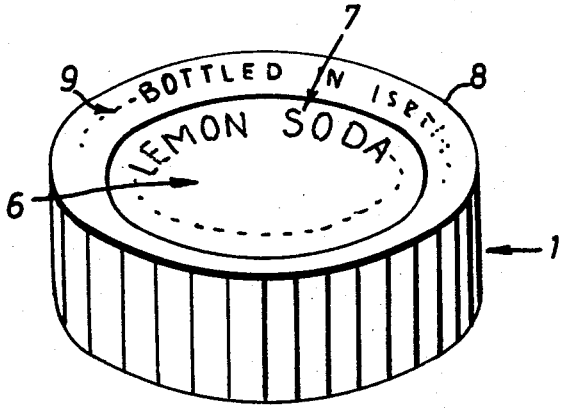
FIG. 2 shows the synthetic plastic closure cap according to FIG. 1 in perspective representation on an enlarged scale.

According to FIGS. 1 and 2 a synthetic plastic closure cap 1 consists of a top plate 2 and a cylindrical part 3 which surrounds the neck 4 of a bottle 5 and is secured by means of a screw threading (not shown). As illustrated the top plate 2 has a lid surface 6 which is provided with an imprint 7 for the marking of the contents of the bottle. To protect the imprint 7 in this case the lid surface 6 is surrounded by an elevated portion 8 which protrudes above the lid surface 6.

If therefore as illustrated for example a second bottle 5*a* is placed in storage upon the bottle 5, the imprint 7 reliably remains undamaged.

In order to provide additional space for the inscription and guarantee good printability of the lid surface 6, the elevated portion 8 is provided with a flank 9 which on the one hand itself can be printed and on the other hand prevents distortion of the entire printed image when pad-type printing machines are used.

Figure 3:
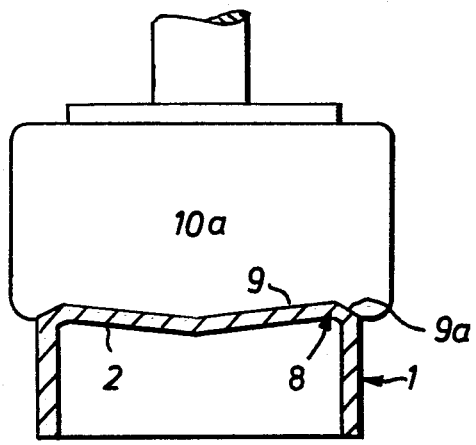
FIG. 3 shows a synthetic plastic closure cap according to the invention during printing with a silicone pad.

FIG. 3 shows a modified example of embodiment of a closure cap having the features of the invention, in which the elevated portion 8 is at a distance from the outermost diameter of the cap. As illustrated it is thus possible with the silicone pad 10*a* to print even the outwardly falling-away flanks 9*a*.

Figure 4:
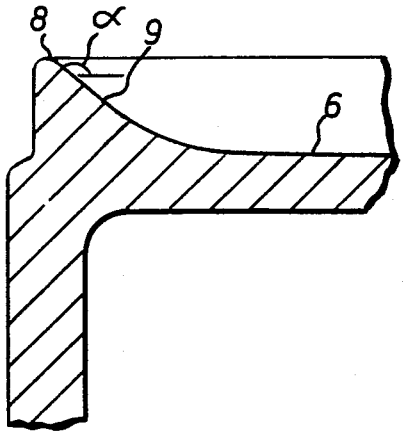
FIG. 4 shows a partial section through the marginal region of the cap upper surface on an enlarged scale.
Figure 5:
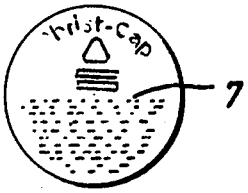
FIG. 5 shows a plan view of a printed closure cap having the features of the invention.
Figure 6:
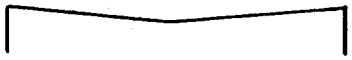
FIGS. 6 to 10 show diagrammatic representations of modified forms of embodiment of the invention, with modified elevated portions in each case.
Figure 7:
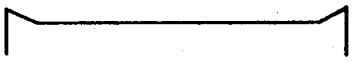
Figure 8:
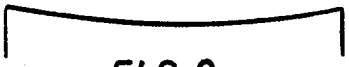
Figure 9:
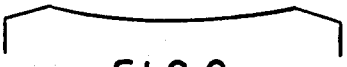
Figure 10:
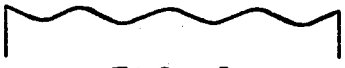

In FIG. 4 the rounded off transition from the bevel 9 to the lid surface 6 of disc form is especially clearly represented. In order to ensure printability of the curvature, the radius of such curvature should be not less than 4 mm. Likewise the angle $\alpha$ between the flanks of the elevated portion 8 and the horizontal sectional plane of the cap should not be greater than 160° at maximum. Preferably this angle should be not less than 140°, and the preferred range is 150° to 160°. In this way the surface of the closure cap 1 can be printed in an optimally simple manner even into the outermost marginal region, as illustrated in FIG. 5. Unintentional damage of the imprint 7 is no longer possible in the case of the configuration of the closure cap 1 in accordance with the invention.

As represented in FIGS. 6 to 10, the invention can readily be adapted to special requirements of the individual case, and especially it is possible to form elevated portions and domings in accordance with the design of the imprint, or of the marking, without thereby departing from the fundamental idea of the invention.

We claim:

1. Synthetic plastic closure cap for bottles, consisting of a cylindrical part and a top plate integral therewith, the upper side of which bears printed material, characterised by an elevated portion provided on the upper side and extending approximately concentrically with said cylindrical part in the marginal region of the upper side of said top plate and surrounding said printed material so as to provide protection of the printed material against mechanical damage, the elevated portion rising gradually at such a shallow angle that even the elevated portion is readily printable at least in a partial zone thereof.

2. Synthetic plastic closure cap according to claim 1, characterised in that the upper side of the cap has a middle part of disc form extending approximately flatly which merges with a rounded transition into the inner sides of the elevated portion.

3. Synthetic plastic closure cap according to claim 1, characterised in that the radius of curvature of the upper side of the top plate is not smaller than 4 mm. at any point along the inner side of the elevated portion.

4. Synthetic plastic closure cap according to claim 1, characterised in that the inner side of the elevated portion at no point rises at an angle which is less than 140° in relation to a plane normal to the central axis of the cap.

5. Synthetic plastic closure cap according to claim 4, characterised in that the angle of rise of the elevated portion in relation to said normal plane lies between 150° and 160°.

6. A molded synthetic plastic closure cap for bottles, comprising a cylindrical cap part and an integral top plate, said top plate having printed material on the upper side thereof, said top plate being provided with an elevated portion around the outer edge of the top plate surrounding said printed material, the elevated portion coinciding on the outside approximately with the external diameter of the cylindrical cap part and merging into said external diameter, the elevated portion merging downwardly on the inner side into an approximately flatly extending section of disc form, said top plate and the inner side of said elevated portion, as viewed in elevation section, being devoid of any curvature of a radius less than 4 mm, and the included angle between the plane of said flatly extending section and any plane tangent to the inner side of said elevated portion being not less than 140° such that the angle of rise at any point on said elevated portion, measured from said flaty extending section, is not less than 140°.

7. A closure cap as claimed in claim 6 wherein said printed material is located on said flatly extending section and at least part of the inner side of said elevated portion.

8. A closure cap as claimed in claim 7 wherein said printed material extends substantially to the outermost marginal region of the inner side of said elevated portion.

* * * * *